US009711834B2

(12) United States Patent
Wada et al.

(10) Patent No.: US 9,711,834 B2
(45) **Date of Patent: *Jul. 18, 2017**

(54) IRREVERSIBLE CIRCUIT ELEMENT AND MODULE

(71) Applicant: Murata Manufacturing Co., Ltd., Nagaokakyo-shi, Kyoto-fu (JP)

(72) Inventors: Takaya Wada, Nagaokakyo (JP); Yoshiki Yamada, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 39 days.

This patent is subject to a terminal disclaimer.

(21) Appl. No.: 14/838,425

(22) Filed: Aug. 28, 2015

(65) Prior Publication Data

US 2015/0372365 A1 Dec. 24, 2015

Related U.S. Application Data

(63) Continuation of application No. PCT/JP2014/054288, filed on Feb. 24, 2014.

(30) Foreign Application Priority Data

Mar. 8, 2013 (JP) ..... 2013-046077
Oct. 23, 2013 (JP) ..... 2013-220182

(51) Int. Cl.
*H01P 1/36* (2006.01)
*H01P 1/365* (2006.01)
(Continued)

(52) U.S. Cl.
CPC ..... *H01P 1/365* (2013.01); *H01F 7/0278* (2013.01); *H01F 38/14* (2013.01); *H01P 1/213* (2013.01);
(Continued)

(58) Field of Classification Search
CPC ..... H01P 1/36; H01P 1/38; H01P 1/383
(Continued)

(56) References Cited

U.S. PATENT DOCUMENTS 5,973,568 A 10/1999 Shapiro et al.
9,088,064 B2 * 7/2015 Wada ..... H01P 1/36
(Continued)

FOREIGN PATENT DOCUMENTS

CN 101371399 A 2/2009
CN 102195593 A 9/2011
(Continued)

OTHER PUBLICATIONS

Official Communication issued in International Patent Application No. PCT/JP2014/054288, mailed on May 20, 2014.

*Primary Examiner* — Stephen E Jones
(74) *Attorney, Agent, or Firm* — Keating & Bennett, LLP

(57) ABSTRACT

An irreversible circuit element includes first and second high pass isolators each including first and second center electrodes intersecting with and being insulated from each other on a ferrite to which a direct-current magnetic field is applied with a permanent magnet. One end of the first center electrode is an output port and the other end thereof is an input port, and one end of the second center electrode is another output port and the other end thereof is a ground port. A pass frequency band of the first isolator is higher than a pass frequency band of the second isolator. Respective output portions of the first and second isolators are electrically connected and defined as one output terminal, and a low pass filter LPF is inserted between the output terminal and the output port of the second isolator.

9 Claims, 15 Drawing Sheets

(51) Int. Cl.
*H01F 7/02* (2006.01)
*H01F 38/14* (2006.01)
*H01P 1/213* (2006.01)

(52) U.S. Cl.
CPC ..... *H01P 1/2135* (2013.01); *H01P 1/36* (2013.01); *H01F 2038/146* (2013.01)

(58) Field of Classification Search
USPC ..... 333/1.1, 24.2
See application file for complete search history.

(56) References Cited

U.S. PATENT DOCUMENTS

| | | | |
|---|---|---|---|
| 2008/0218289 | A1 | 9/2008 | Wada |
| 2011/0204989 | A1 | 8/2011 | Wada |
| 2014/0080431 | A1 | 3/2014 | Wada et al. |
| 2015/0171499 | A1 | 6/2015 | Wada |

FOREIGN PATENT DOCUMENTS

| | | | |
|---|---|---|---|
| JP | 07-283615 | A | 10/1995 |
| JP | 09-93004 | A | 4/1997 |
| JP | 2002-517930 | A | 6/2002 |
| JP | 2011-176668 | A | 9/2011 |
| WO | 2012/172882 | A1 | 12/2012 |
| WO | 2014/034347 | A1 | 3/2014 |

* cited by examiner

IRREVERSIBLE CIRCUIT ELEMENT AND MODULE

BACKGROUND OF THE INVENTION

1. Field of the Invention

The present invention relates to irreversible circuit elements, particularly irreversible circuit elements preferably for use in microwave bands, such as isolators, circulators, and the like, and also relates to modules provided including such irreversible circuit elements.

2. Description of the Related Art

In general, conventional irreversible circuit elements such as isolators, circulators, and the like have characteristics that signals are transmitted only in a predetermined specific direction and not transmitted in the reverse direction. Isolators, for example, are used in transmission circuits of mobile communication devices such as cellular phones and the like while making use of the above characteristics.

Recently, it has become possible for a single cellular phone to carry out communication operation in a plurality of different frequency bands. In order to implement this function, Japanese Unexamined Patent Application Publication No. 2002-517930 proposes a power amplification module for a dual mode digital system in which two transmission output portions are connected to an antenna through a diplexer.

However, in the proposed module, a tuner is needed to be provided, in addition to the diplexer, between the diplexer and the antenna for impedance matching in order to support a plurality of frequency bands. This increases the number of components, costs, and so on. Further, the proposed module has a problem that load fluctuation (impedance fluctuation) on the antenna side directly gives unfavorable influence on the transmission circuits.

SUMMARY OF THE INVENTION

Preferred embodiments of the present invention provide irreversible circuit elements and modules capable of operating in a plurality of frequency bands, reducing the number of components, costs, and so on, and significantly reducing or preventing load fluctuation on the antenna side.

An irreversible circuit element according to a first aspect of various preferred embodiments of the present invention includes a first high pass type isolator and a second high pass type isolator in each of which there are provided first and second center electrodes that are arranged intersecting with and being insulated from each other on a ferrite to which a direct-current magnetic field is applied with a permanent magnet; one end of the first center electrode is defined as an output port and the other end thereof is defined as an input port, and one end of the second center electrode is defined as another output port and the other end thereof is defined as a ground port; and a resistance element and a capacitance element connected in parallel to each other are connected between the input port and the output port in series; wherein a pass frequency band of the first isolator is higher than a pass frequency band of the second isolator; respective output portions of the first and second isolators are electrically connected and defined as one output terminal; and a low pass filter is inserted between the output terminal and the output port of the second isolator.

In a module according to a second aspect of various preferred embodiments of the present invention, the output terminal of the irreversible circuit element is connected to an antenna side.

In each of the first and second isolators in the irreversible circuit element, a portion between the input port and the output port is at the same potential due to action of the ferrite; in the case where a high frequency signal is inputted from the input port, a current hardly flows in the second center electrode, the resistance element, and the like, but flows through the first center electrode and is outputted to the output port. Meanwhile, in the case where a high frequency signal is inputted from the output port, the high frequency signal current flows in the resistance element without passing the first center electrode due to an irreversible action, and is consumed as heat. In other words, the current is attenuated (isolated).

Further, in the irreversible circuit element, the respective output portions of the first and second isolators are electrically connected and defined as one output terminal so as to define and function as one irreversible circuit element. Furthermore, because the low pass filter is inserted between the output terminal and the output port of the second isolator, a signal in a harmonic band of the second isolator having a lower pass frequency band is attenuated, thus preventing crosstalk with the first isolator having a higher pass frequency band. In addition, the low pass filter is inserted in only one portion between the output terminal and the output port of the second isolator, which significantly reduces or prevents insertion loss, the number of components, and the like from increasing.

In other words, the above-mentioned irreversible circuit element is a substitute for the conventional diplexer in a transmission circuit, and it is unnecessary to provide a tuner for impedance matching on the antenna side. Further, the above irreversible circuit element significantly reduces or prevents load fluctuation (impedance fluctuation) on the antenna side with its isolation action.

In the first isolator and/or the second isolator, input/output terminals of at least one filter may be connected between the resistance element and the output port or the input port, and a ground terminal of the filter may be connected to the input port or the output port. As such, a module according to a third aspect of various preferred embodiments of the present invention is provided with the irreversible circuit element including the above-described filter that passes a transmission band signal and attenuates a receiving band signal, and further includes a branch circuit element that makes a transmission signal and a receiving signal branch to the input port of the first isolator and/or the second isolator provided with the filter.

By including the filter that passes the transmission band signal and attenuates the receiving band signal, a transmission frequency band signal is allowed to pass in a forward direction, while in a reverse direction, the transmission frequency band signal is absorbed and attenuated by internal resistance but a receiving frequency band signal is allowed to pass. Accordingly, transmission waves reflected at the antenna are prevented from coming into the receiving side, which makes it possible to configure a transmitter receiver module.

According to various preferred embodiments of the present invention, operations in a plurality of frequency bands are realized, a reduction in the number of components and costs is achieved, and load fluctuation on the antenna side is significantly reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
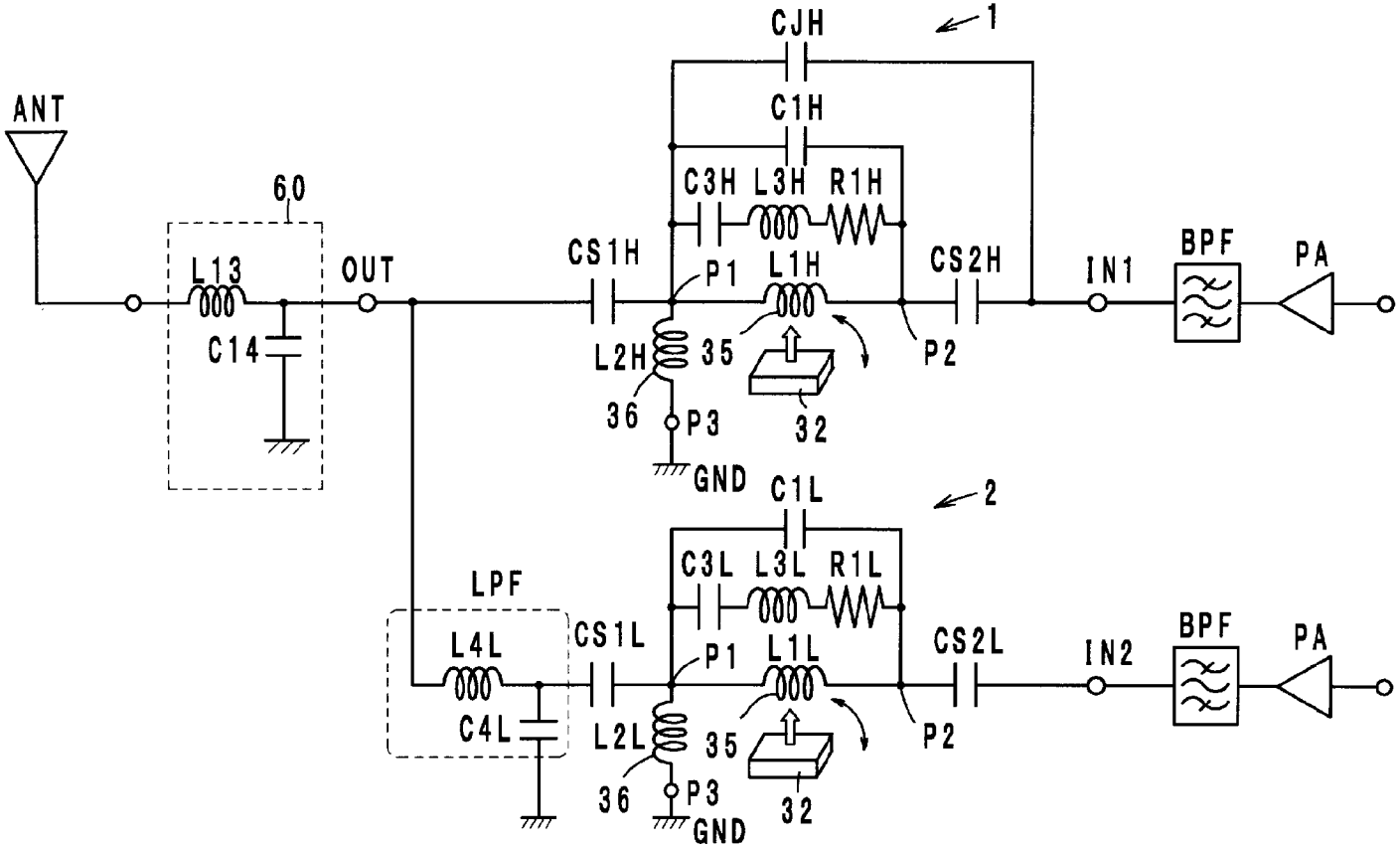
FIG. 1 is an equivalent circuit diagram illustrating an irreversible circuit element according to a first preferred embodiment of the present invention.

Hereinafter, preferred embodiments of irreversible circuit elements and modules according to the present invention will be described with reference to the appended drawings. Note that in the drawings, same members and portions are given the same reference numerals and redundant descriptions thereof will be omitted.

First Preferred Embodiment

Figure 2:
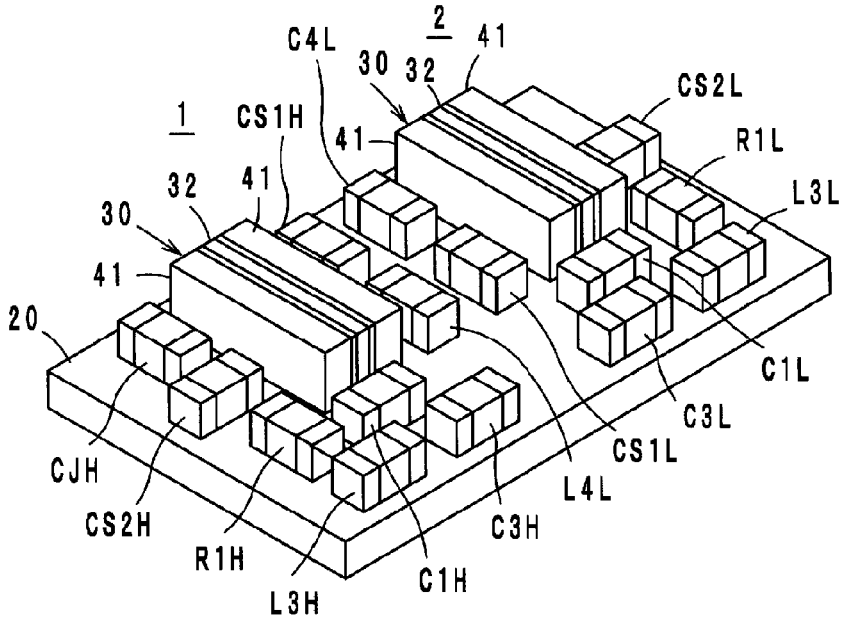
FIG. 2 is a perspective view illustrating an external appearance of the irreversible circuit element.

As illustrated in an equivalent circuit diagram in FIG. 1, an irreversible circuit element according to a first preferred embodiment of the present invention is a circuit element in which a two-port first isolator and a two-port second isolator are configured in combination as an integrated module (see FIG. 2). The first and second isolators 1 and 2 are each a lumped type isolator in which a first center electrode 35 configuring an inductor L1H or L1L and a second center electrode configuring an inductor L2H or L2L are arranged on a microwave magnetic material (hereinafter, referred to as "ferrite 32") while being intersecting with and insulated from each other.

The isolators 1 and 2 are both high pass type isolators, and a pass frequency band of the first isolator 1 is set to be higher than a pass frequency band of the second isolator 2. Respective output portions of the first and second isolators 1 and 2 are electrically connected and defined as one output terminal OUT, and input portions thereof are defined as input terminals IN1 and IN2, respectively. Further, a low pass filter LPF (an L-type resonance circuit including an inductor L4L and a capacitor C4L) is inserted between the output terminal OUT and the output portion of the second isolator 2 (the output portion is an output port P1; note that in this preferred embodiment, a capacitor CS1L is inserted and connected to the output port P1).

Circuit configurations of the first and second isolators 1 and 2 will be described below with reference to FIG. 1. Note that the letter "H" is added to the end of a reference numeral for each circuit component in the first isolator 1, and the letter "L" is added for each circuit component in the second isolator 2. Although the description below is focused on the configuration of the first isolator 1, the configuration of the second isolator 2 is the same as that of the first isolator 1.

In the isolator 1, the first and second center electrodes 35 and 36 (inductors L1H, L2H) are arranged on a surface of the ferrite 32 while intersecting with and being insulated from each other, the first and second center electrodes 35 and 36 are magnetically coupled to each other by applying a direct-current magnetic field (N-S) to the intersecting portion from a permanent magnet 41 (see FIGS. 2 and 3), one end of the first center electrode 35 is defined as the output port P1 and the other end thereof is defined as the input port P2, and one end of the second center electrode 36 is also defined as the output port P1 and the other end thereof is defined as a ground port P3. The output port P1 is connected to the output terminal OUT through a matching capacitor CS1H, and the input port P2 is connected to the input terminal IN1 through a matching capacitor CS2H.

Between the output port P1 and the input port P2, a matching capacitor C1H is connected in parallel with the first center electrode 35, and a resistor R1H and an LC series resonance circuit (including an inductor L3H and a capacitor C3H) are connected in parallel with the first center electrode 35. A capacitor CJH is further connected between the output port P1 and the input port IN1. The capacitor CJH adjusts insertion loss and isolation. Note that the capacitor CJH is omitted in the second isolator 2.

The irreversible circuit element is integrated in a transmission circuit of a cellular phone. That is, the output terminal OUT is connected to an antenna ANT through a matching circuit 60 (including an inductor L13 and a capacitor C14). Further, the input terminals IN1 and IN2 are connected to transmission-side power amplifiers PA through band pass filters BPF, respectively.

In each of the isolators 1 and 2, a portion between the port P1 and the port P2 is at the same potential due to action of the ferrite 32; in the case where a high frequency signal is inputted from the input port P2, a current hardly flows in the second center electrode 36, the resistor R1H, and the like, but flows through the first center electrode 35 and is outputted to the output port P1. Meanwhile, in the case where a high frequency signal is inputted from the output port P1, the high frequency signal current flows in the resistor R1H without passing the first center electrode 35 due to an irreversible action, and is consumed as heat. In other words, the current is attenuated (isolated).

In an operation in which a signal is transmitted from the input port P2 to the output port P1, because a high frequency current hardly flows as well in the resistor R1H, the LC series resonance circuit (inductor L3H and capacitor C3H), and the like, loss by the LC series resonance circuit can be ignored and insertion loss will not increase. Meanwhile, in the case where a high frequency current is inputted to the output port P1, matching is achieved across a wide band with impedance characteristics of the resistor R1H and the LC series resonance circuit, such that isolation characteristics are improved.

Here, characteristics of the isolators 1 and 2 will be described with reference to FIGS. 4 through 7.

Figure 4:
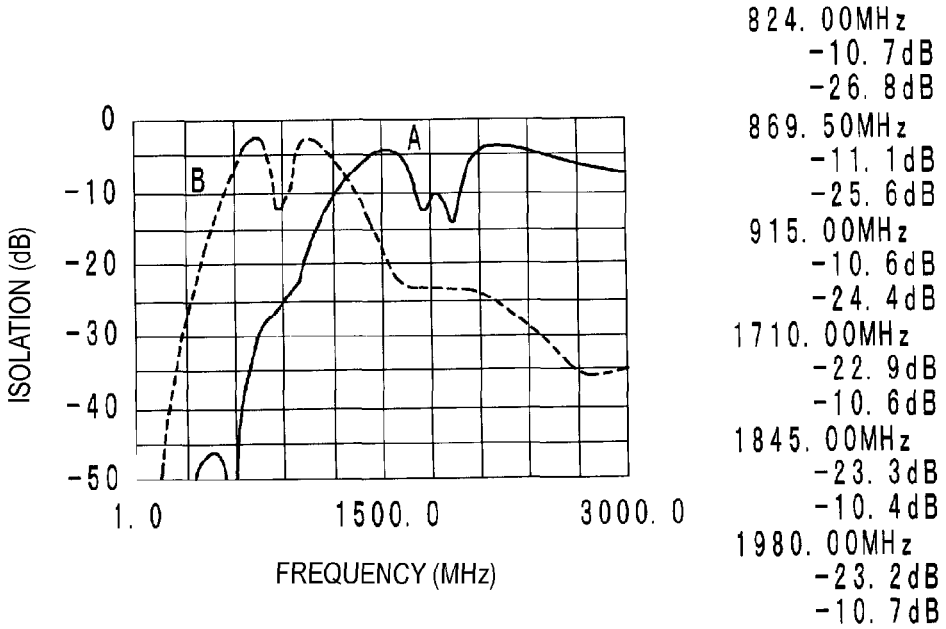
FIG. 4 is a graph illustrating an isolation characteristic of the isolator.
Figure 5:
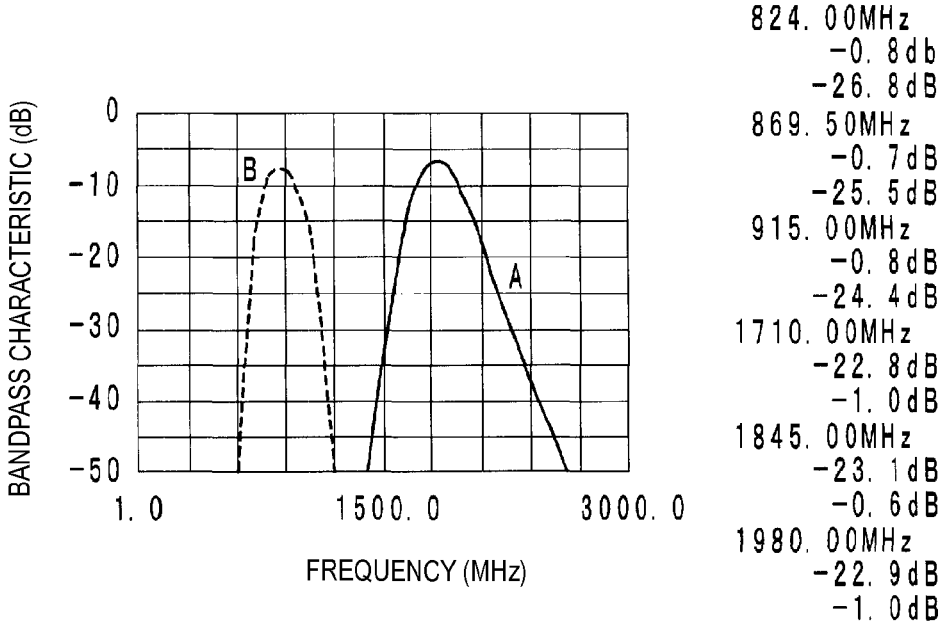
FIG. 5 is a graph illustrating a bandpass characteristic of the isolator.

In FIG. 4, isolation characteristics are given, that is, an isolation characteristic from the output terminal OUT to the input terminal IN1 is indicated by a curved line A, and an isolation characteristic from the output terminal OUT to the input terminal IN2 is indicated by a curved line B. In FIG. 5, bandpass characteristics are given, that is, a bandpass characteristic from the input terminal IN1 to the output terminal OUT is indicated by a curved line A, and a bandpass characteristic from the input terminal IN2 to the output terminal OUT is indicated by a curved line B.

Due to action of the low pass filter LPF, an input composition of no more than about −0.8 dB at 824 MHz to 915 MHz and an input composition of no more than about −1.0 dB at 1710 MHz to 1980 MHz are obtained, as shown in FIG. 5. As for the isolation characteristics, a level of not less than about −10 dB is obtained at 824 MHz to 915 MHz and at 1710 MHz to 1980 MHz, as shown in FIG. 4.

Figure 6:
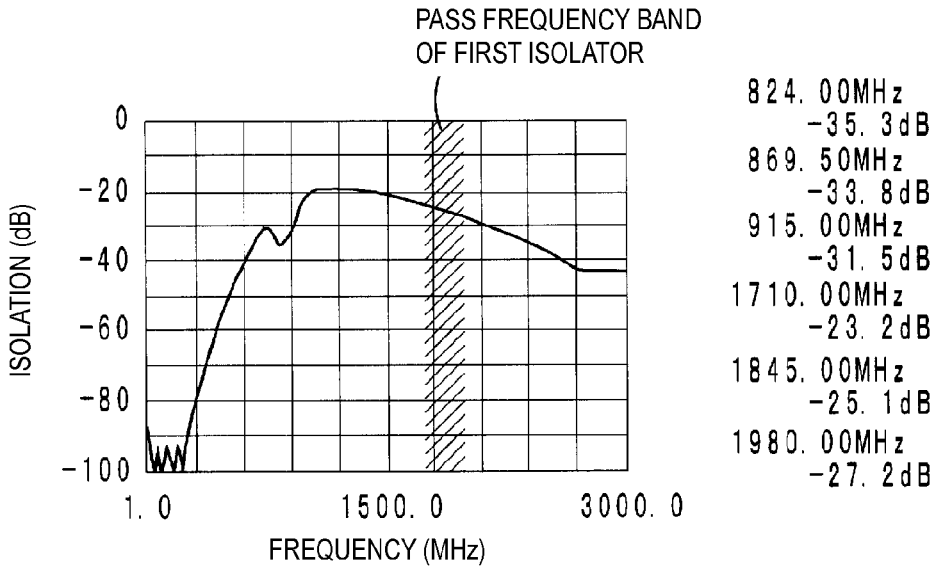
FIG. 6 is a graph illustrating an isolation characteristic from a first isolator to a second isolator.
Figure 7:
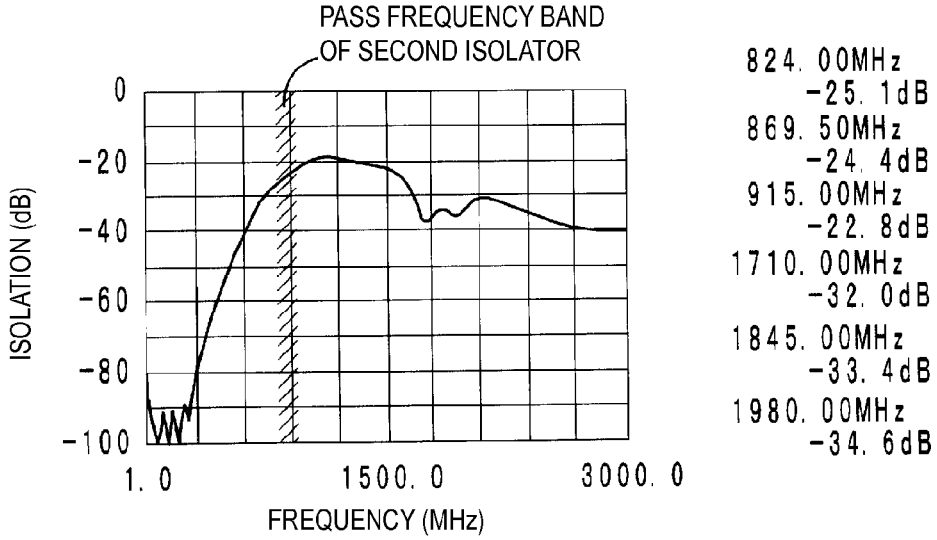
FIG. 7 is a graph illustrating an isolation characteristic from the second isolator to the first isolator.

FIG. 6 shows an isolation characteristic from the first isolator 1 to the second isolator, and FIG. 7 shows an isolation characteristic from the second isolator to the first isolator. As is clear from FIGS. 6 and 7, the isolators 1 and 2 each define and function as a diplexer that separates each of the pass frequency bands respectively indicated by oblique lines from the rest, and exhibit a signal attenuation effect of not less than about −20 dB.

As described thus far, in the first preferred embodiment, the respective output portions of the isolators 1 and 2 are electrically connected and defined as the one output terminal OUT, thus defining and functioning as one irreversible circuit element. Further, because the low pass filter LPF is inserted between the output terminal OUT and the output port P1 of the second isolator 2, a harmonic band of the second isolator having a lower pass frequency band is attenuated, thus preventing crosstalk with the first isolator 1 having a higher pass frequency band. In addition, the low pass filter LPF is inserted in only one portion between the output terminal OUT and the output port P1 of the second isolator 2, which significantly reduces or prevents insertion loss, the number of components, and the like from increasing.

In other words, the isolators 1 and 2 configured as one module are a substitute for the conventional diplexer in a transmission circuit, and make it unnecessary to provide a tuner for impedance matching on the antenna ANT side. Further, the isolators 1 and 2 significantly reduce or prevent load fluctuation (impedance fluctuation) on the antenna ANT side with the isolation action thereof.

Next, specific configurations of the first and second isolators 1 and 2 will be described with reference to FIGS. 2 and 3. As shown in FIG. 2, the isolators 1 and 2 are mounted on a substrate 20, and are each configured of a ferrite magnet element 30, which is including the ferrite 32 and a pair of the permanent magnets 41, and various chip-type elements.

On the ferrite 32, the first center electrode 35 and the second center electrode 36 are wound being electrically insulated from each other. The permanent magnet 41 is attached to the ferrite 32 using, for example, an epoxy-based adhesive 42 so as to apply a direct-current magnetic field to the ferrite 32 in a thickness direction thereof (see an arrow N-S in FIG. 3).

Figure 3:
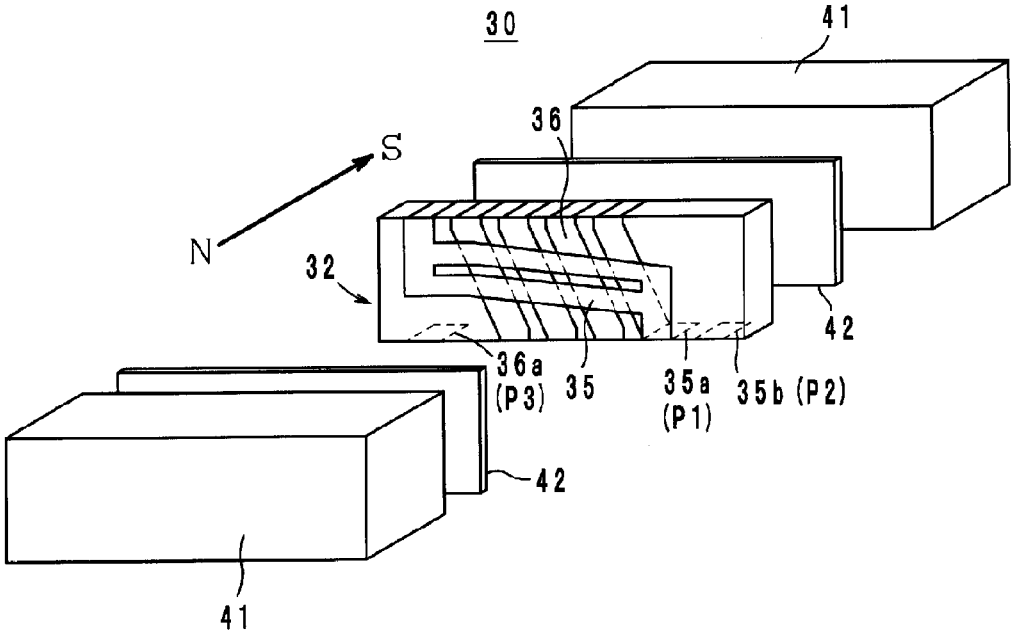
FIG. 3 is an exploded perspective view illustrating ferrite magnet elements that construct respective isolators of the irreversible circuit element.

As shown in FIG. 3, the first center electrode 35 is wound a single turn on the ferrite 32, one end electrode 35*a* is defined as the output port P1, and the other end electrode 35*b* is defined as the input port P2. The second center electrode 36 is wound four turns, for example (note that the number of turns can be arbitrarily determined) on the ferrite 32 while intersecting with the first center electrode 35 at a predetermined angle, the one end electrode 35*a* (shared with the first center electrode 35) is defined as the output port P1, and the other end electrode 36*a* is defined as the ground port P3. Note that in FIG. 3, in order to avoid complication, electrodes on a rear surface side of the ferrite 32 are not illustrated.

The circuit substrate 20 is a resin substrate in which a resin material and conductive foil are laminated; on an upper surface thereof, terminal electrodes (not shown) are provided, and these terminal electrodes are connected, through via hole conductors (not shown), to the terminals for external connection IN1, IN2, OUT, and GND (see FIG. 1) provided on a lower surface of the circuit substrate 20 so as to provide the equivalent circuit shown in FIG. 1.

Second Preferred Embodiment

Figure 8:
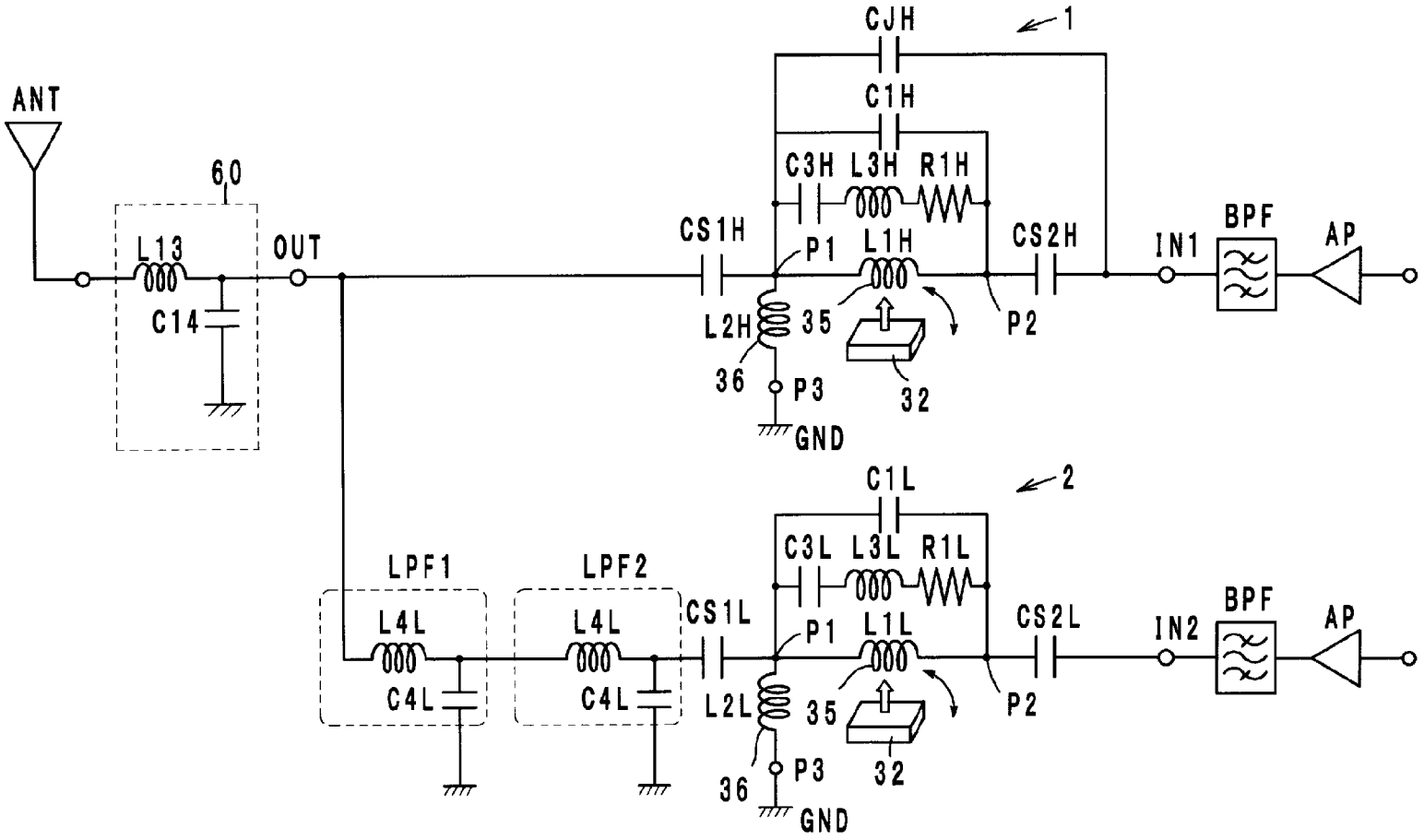
FIG. 8 is an equivalent circuit diagram illustrating an irreversible circuit element according to a second preferred embodiment of the present invention.

As shown in FIG. 8, an irreversible circuit element according to a second preferred embodiment of the present invention basically has the same circuit configuration as that of the first preferred embodiment, in which two-staged low pass filters LPF1 and LPF2 are inserted between the output terminal OUT and the output portion of the second isolator 2. The low pass filters LPF1 and LPF2 each configure an L-type resonance circuit including the inductor L4L and the capacitor C4L; an action effect thereof is basically the same as that of the above-described low pass filter LPF.

Third Preferred Embodiment

Figure 9:
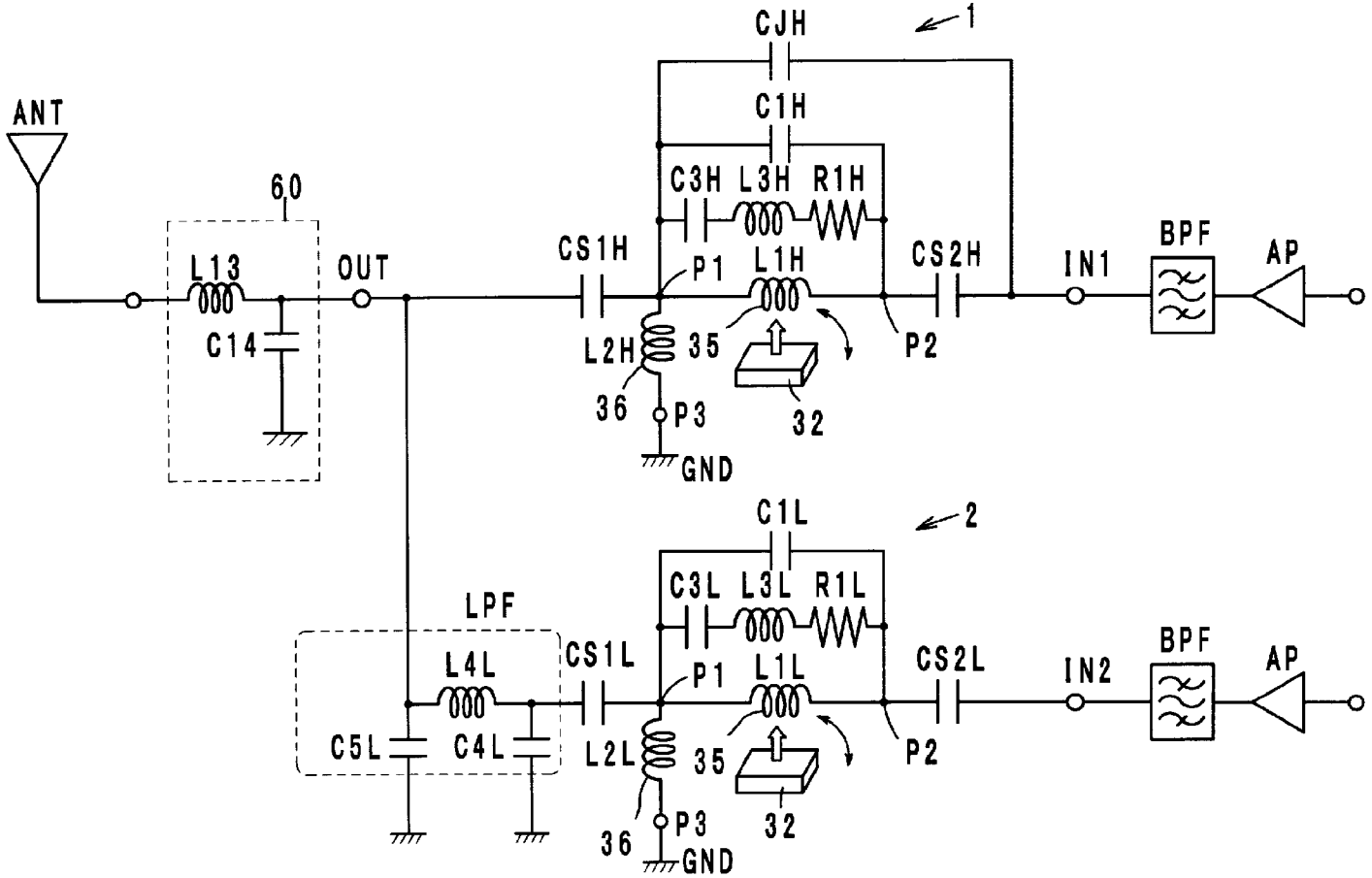
FIG. 9 is an equivalent circuit diagram illustrating an irreversible circuit element according to a third preferred embodiment of the present invention.

As shown in FIG. 9, an irreversible circuit element according to a third preferred embodiment of the present invention basically has the same circuit configuration as that of the first preferred embodiment, in which a low pass filter LPF inserted between the output terminal OUT and the output portion of the second isolator 2 is constituted by a π-type resonance circuit including the inductor L4L, the capacitor C4L, and a capacitor CSL. An action effect of the π-type low pass filter LPF is also the same as that of the L-type low pass filter LPF.

Fourth Preferred Embodiment

Figure 10:
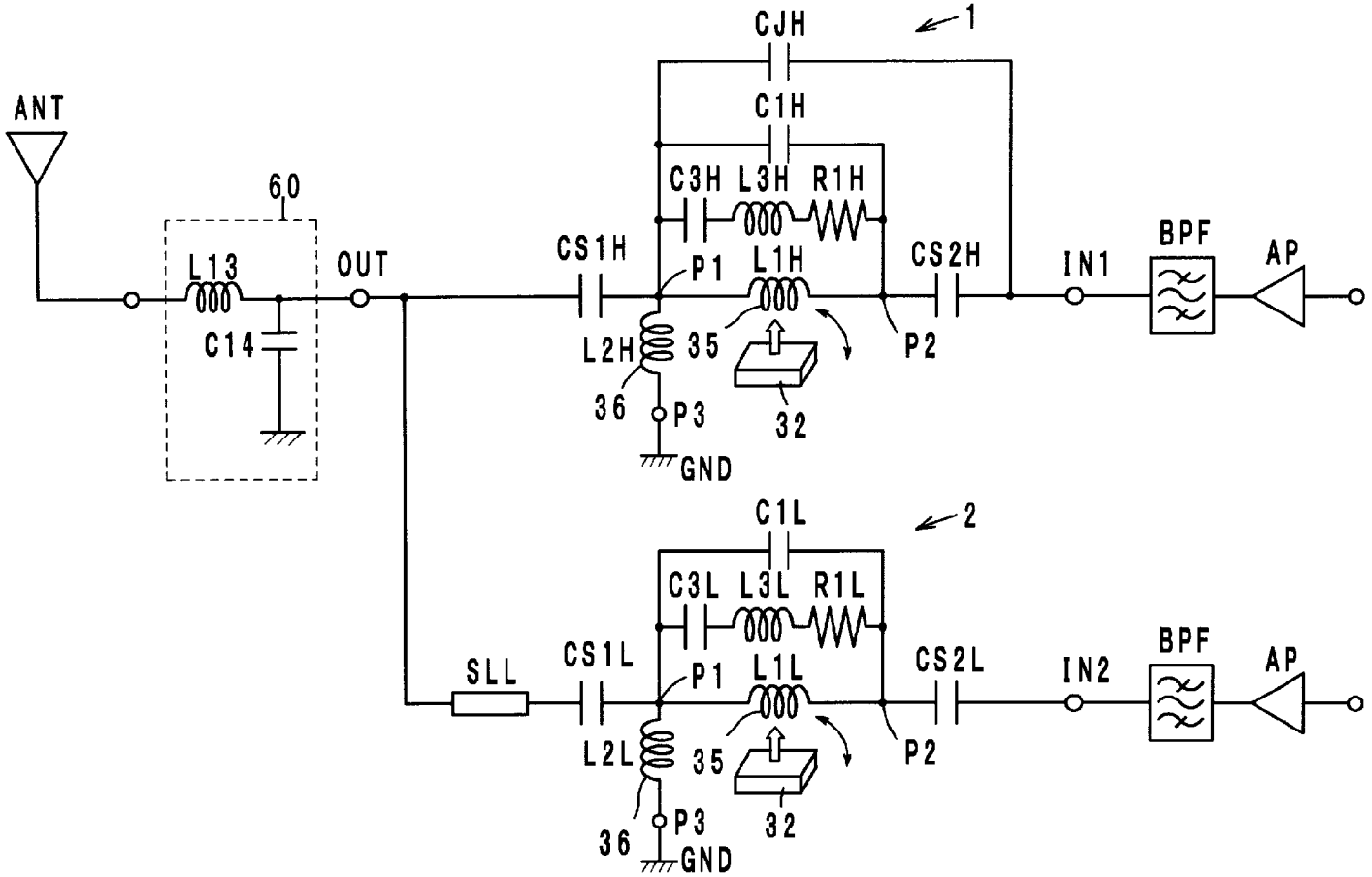
FIG. 10 is an equivalent circuit diagram illustrating an irreversible circuit element according to a fourth preferred embodiment of the present invention.

As shown in FIG. 10, an irreversible circuit element according to a fourth preferred embodiment of the present invention basically has the same circuit configuration as that of the first preferred embodiment, in which a strip line SLL is inserted between the output terminal OUT and the output portion of the second isolator 2. The strip line SLL defines and functions as a low pass filter and an action effect thereof is the same as that of the low pass filter LPF.

Fifth Preferred Embodiment

Figure 11:
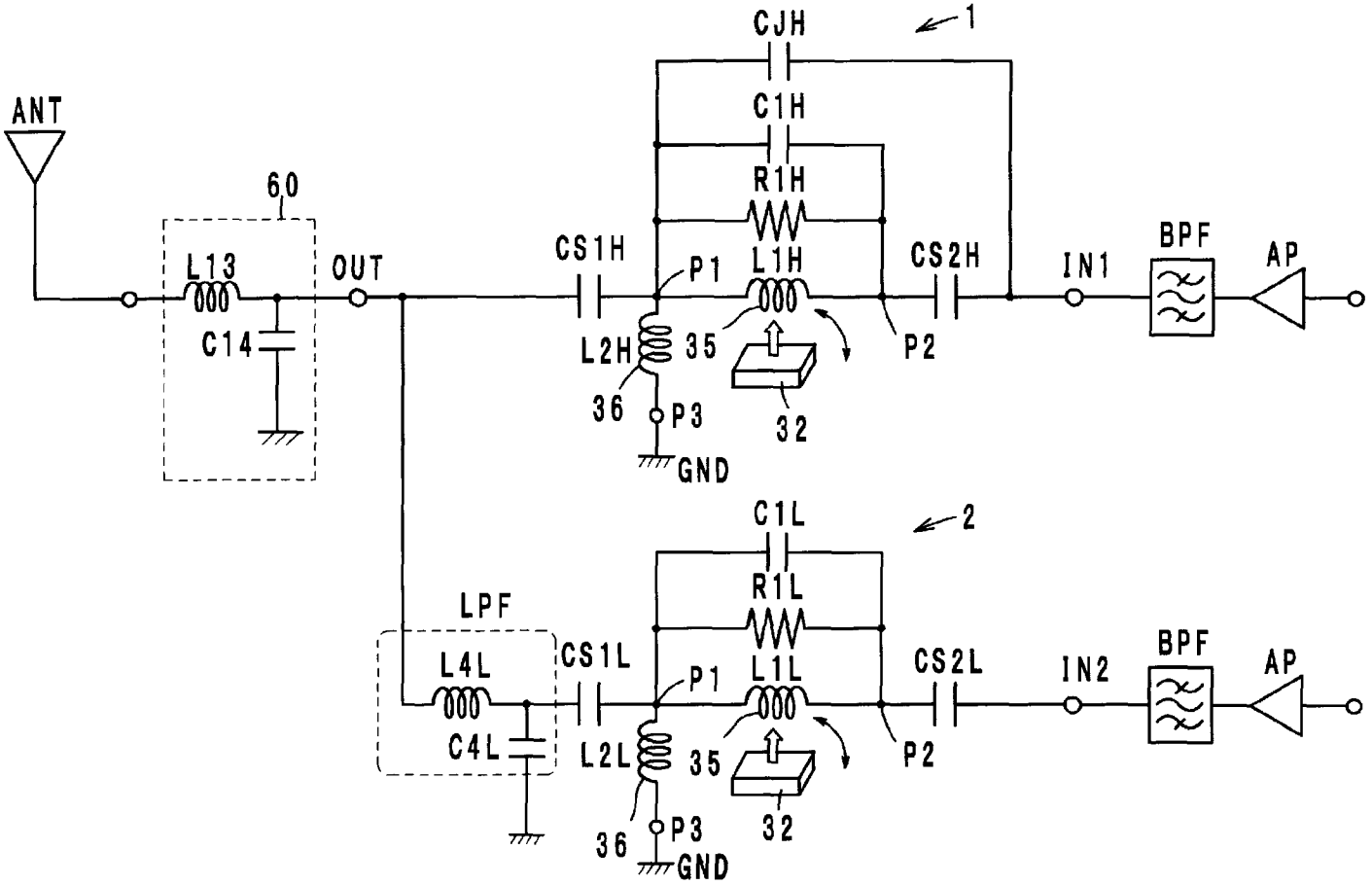
FIG. 11 is an equivalent circuit diagram illustrating an irreversible circuit element according to a fifth preferred embodiment of the present invention.

As shown in FIG. 11, an irreversible circuit element according to a fifth preferred embodiment of the present invention basically has the same circuit configuration as that of the first preferred embodiment, in which the LC series resonance circuits (inductors L3H and L3L, and capacitors C3H and C3L) are omitted from the equivalent circuit shown in FIG. 1. The L-type low pass filter LPF discussed above is inserted between the output terminal OUT and the output portion of the second isolator 2, and an action effect thereof is the same as that of the first preferred embodiment.

Sixth Preferred Embodiment

Figure 12:
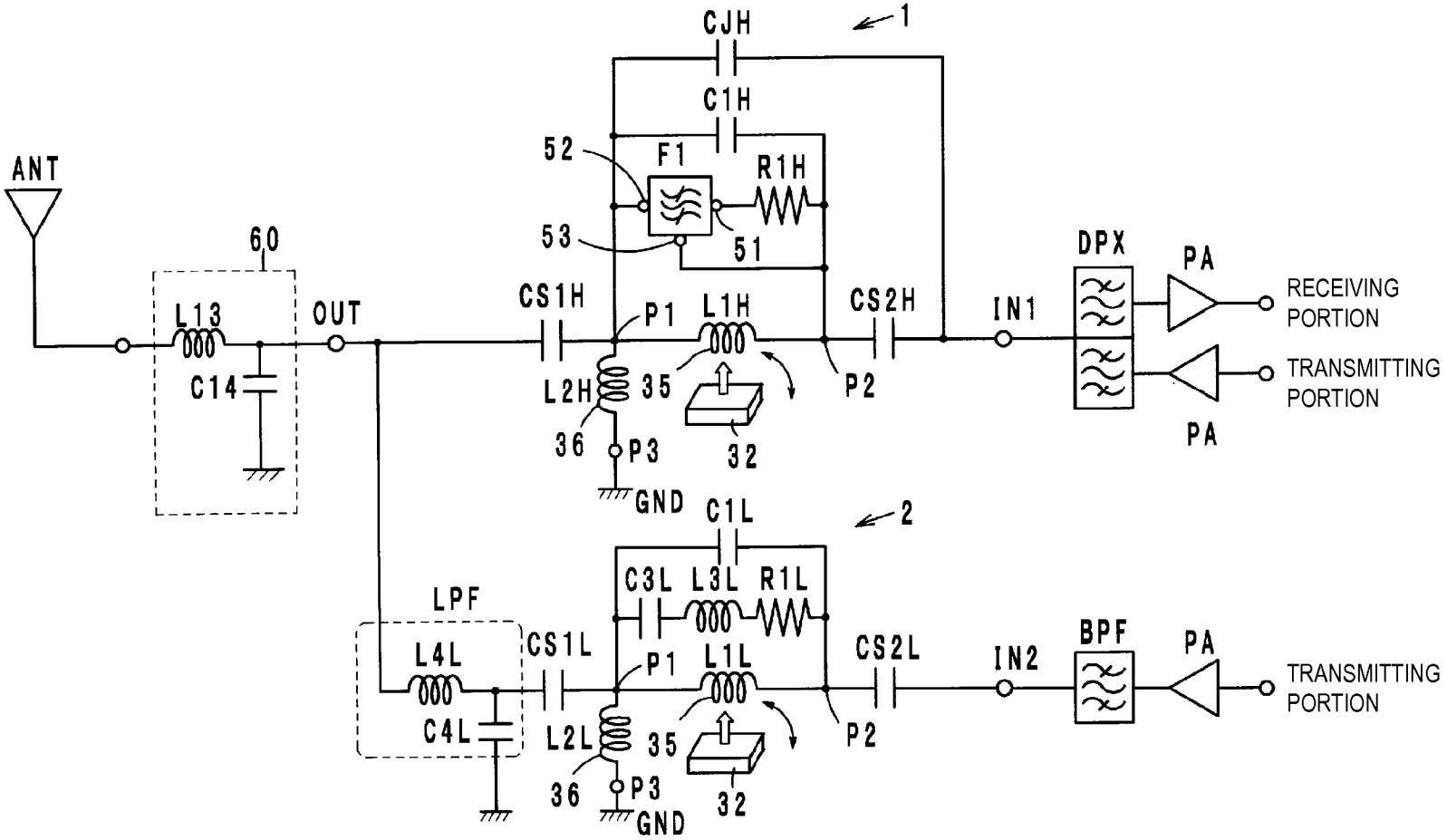
FIG. 12 is an equivalent circuit diagram illustrating an irreversible circuit element according to a sixth preferred embodiment of the present invention.

As shown in FIG. 12, an irreversible circuit element according to a sixth preferred embodiment of the present invention includes, in the first isolator 1, a filter (bandpass filter) F1 in place of the capacitor C3H and the inductor L3H having been discussed in the first preferred embodiment and the like. The filter F1 includes input/output terminals 51, 52 and a ground terminal 53; the input/output terminal 51 is connected to the resistor R1H, the input/output terminal 52 is connected to the output port P1, and the ground terminal 53 is connected to the input port P2. Further, the input terminal IN1 is connected to a receiving portion and a transmitting portion through a transmission/reception branch circuit element (a duplexer DPX, a circulator (not shown), a surface acoustic wave element (not shown), or the like). The other constituent elements of the sixth preferred embodiment are the same as the corresponding constituent elements of the first preferred embodiment.

In the first isolator 1 configured as described above, in the case where a high frequency current is inputted from the input terminal IN1 to the port 2 (forward direction), the current hardly flows in the second center electrode 36, the resistor R1H, and the like, but flows through the first center electrode 35, so that operation is carried out in a wide band with small insertion loss. During the operation in the forward direction, since the high frequency current hardly flows as well in the resistor R1H, the filter F1, and the like, losses by these components can be ignored and insertion loss will not increase.

Meanwhile, in the case where a high frequency current is inputted from the output terminal OUT to the port P1 (reverse direction), the current is absorbed and attenuated in the resistor R1H. By using a filter having such wide band characteristics that match with the port P1 and the port P2 as the filter F1 within a pass band of the irreversible circuit element, the reverse direction characteristics become available in a wide band. Further, by using a filter, as the filter F1, having such characteristics that pass a transmission band signal and attenuate a receiving band signal, a transmission frequency band signal is allowed to pass in the forward direction; in the reverse direction, the transmission frequency band signal is absorbed and attenuated in the internal resistor R1H but a receiving frequency band signal is allowed to pass.

In the sixth preferred embodiment, the first isolator configured as discussed above is preferably disposed between the antenna ANT and the transmission/reception branch circuit element such as the duplexer DPX or the like, where the receiving portion operates in a relatively high frequency band, and the transmitting portion operates in a relatively low frequency band. Here, transmission waves reflected at the antenna ANT are prevented from coming into the receiving portion. This makes it possible to configure a transmission circuit that has a size equal to or smaller than that of the conventional diplexer, significantly suppresses or prevents load fluctuation of the antenna ANT, and operates in a wide band, thus contributing to reduction in size and costs of the transmission circuit.

Here, characteristics of the isolators 1 and 2 according to the sixth preferred embodiment will be described with reference to FIGS. 13 through 16.

Figure 13:
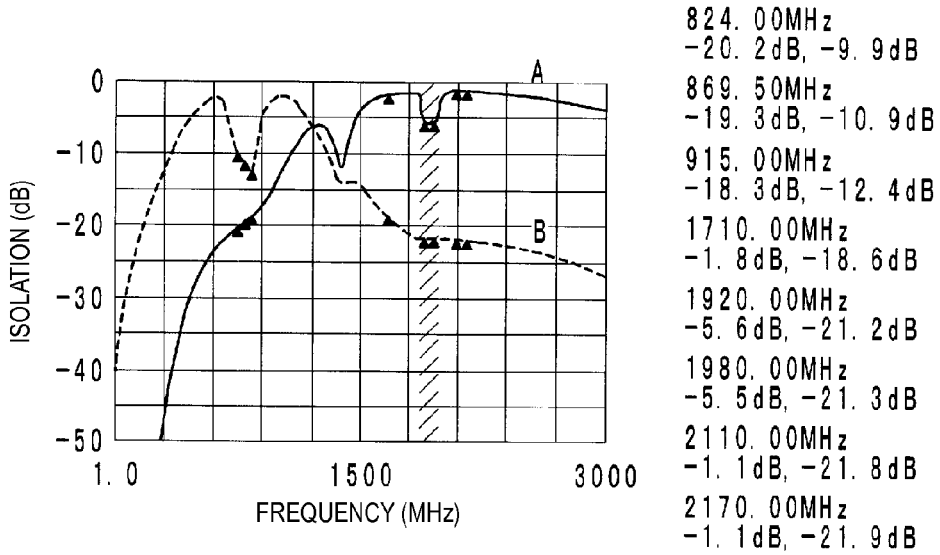
FIG. 13 is a graph illustrating an isolation characteristic of an isolator shown in FIG. 12.
Figure 14:
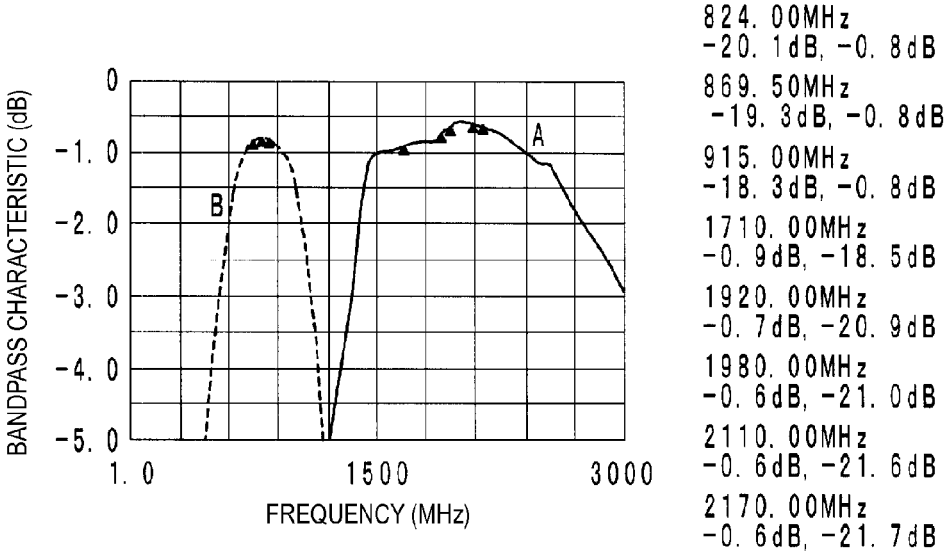
FIG. 14 is a graph illustrating a bandpass characteristic of the isolator shown in FIG. 12.

In FIG. 13, isolation characteristics are given, that is, an isolation characteristic from the output terminal OUT to the input terminal IN1 is indicated by a curved line A, and an isolation characteristic from the output terminal OUT to the input terminal IN2 is indicated by a curved line B. In FIG. 14, bandpass characteristics of the isolators 1 and 2 are given, that is, a bandpass characteristic from the input terminal IN1 to the output terminal OUT is indicated by a curved line A, and a bandpass characteristic from the input terminal IN2 to the output terminal OUT is indicated by a curved line B.

Due to the action of the low pass filter LPF, an input composition of no more than about −0.8 dB at 824 MHz to 915 MHz and an input composition of no more than about −1.0 dB at 1710 MHz to 1980 MHz are obtained, as shown in FIG. 14. As for the isolation characteristics, a level of not less than about −10 dB is obtained at 824 MHz to 915 MHz as shown in FIG. 13. In addition, since the filter F1 is provided in the first isolator 1, isolation of about −6 dB is obtained at 1920 MHz to 1980 MHz, and loss is reduced to be about −1 dB in a receiving band from 2110 MHz to 2170 MHz.

Figure 15:
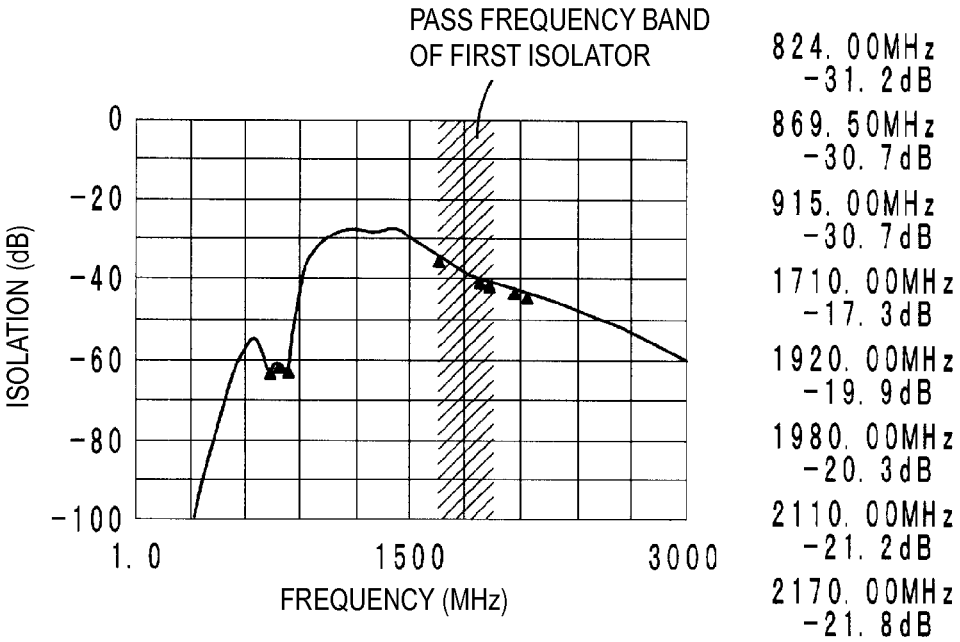
FIG. 15 is a graph illustrating an isolation characteristic from a first isolator to a second isolator shown in FIG. 12.
Figure 16:
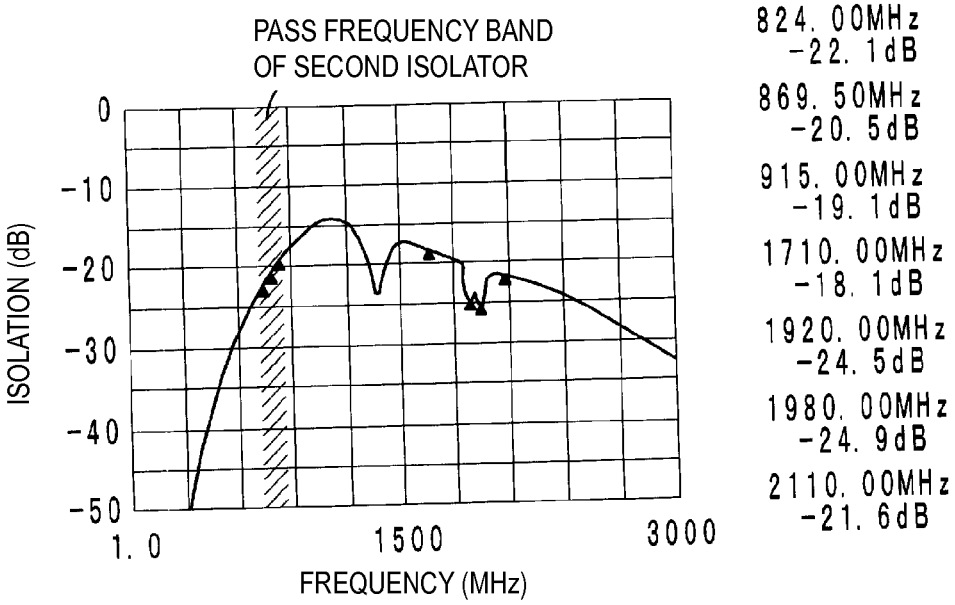
FIG. 16 is a graph illustrating an isolation characteristic from the second isolator to the first isolator shown in FIG. 12.

FIG. 15 shows an isolation characteristic from the first isolator 1 to the second isolator 2, and FIG. 16 shows an isolation characteristic from the second isolator 2 to the first isolator 1. As is clear from FIGS. 15 and 16, the isolators 1 and 2 each define and function as a diplexer that separates each of the pass frequency bands respectively indicated by oblique lines from the rest, and exhibit a signal attenuation effect of not less than about −15 dB to about −20 dB, for example.

Note that in the above sixth preferred embodiment, the input/output terminal 51 of the filter F1 is connected to the resistor R1H, the input/output terminal 52 thereof may be connected to the input port P2, and the ground terminal 53 thereof may be connected to the output port P1.

Seventh Preferred Embodiment

Figure 17:
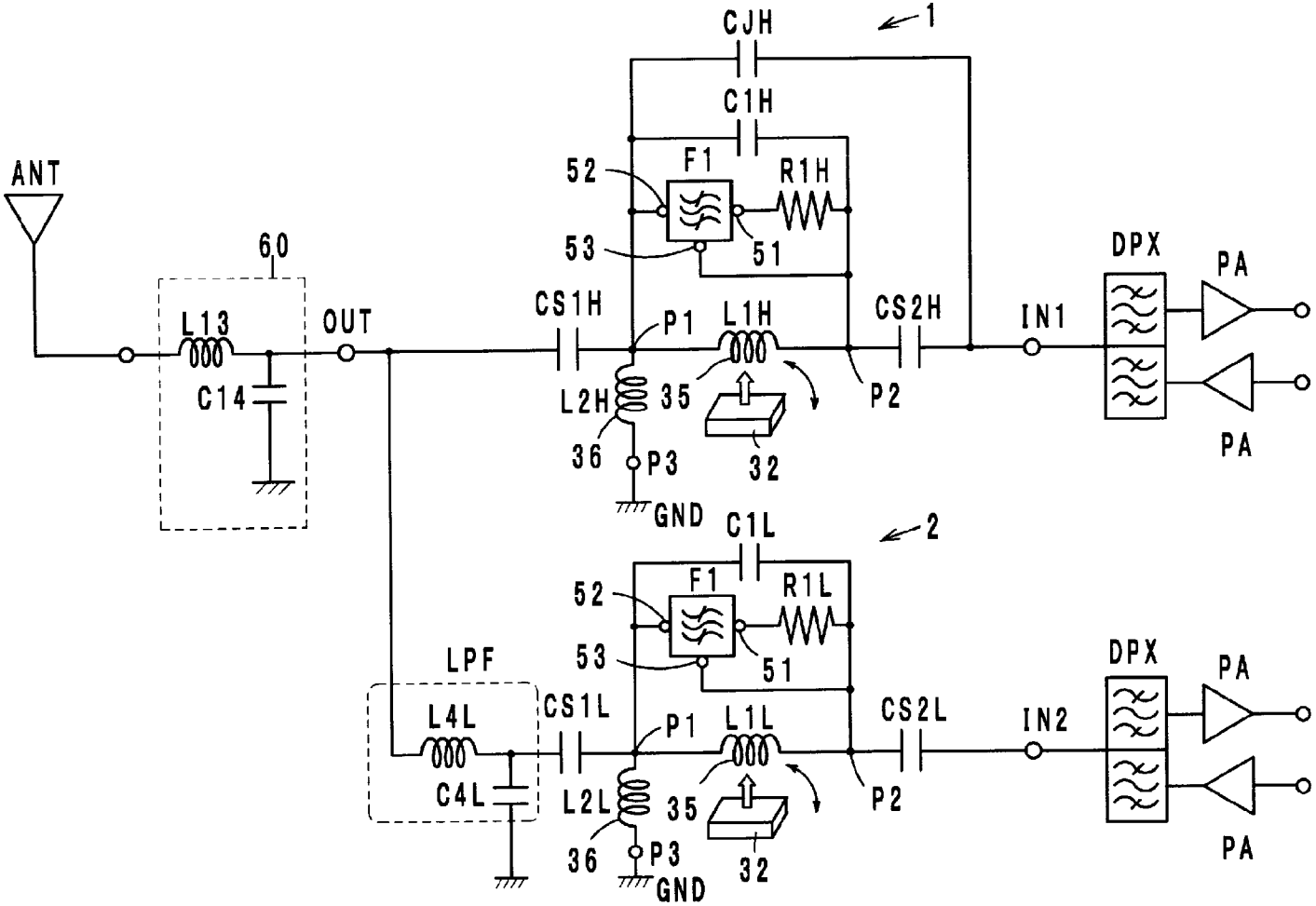
FIG. 17 is an equivalent circuit diagram illustrating an irreversible circuit element according to a seventh preferred embodiment of the present invention.

In an irreversible circuit element according to a seventh preferred embodiment of the present invention, as shown in FIG. 17, the filter (bandpass filter) F1 is provided not only in the first isolator 1 but also in the second isolator 2, and the input terminal IN2 is connected to a receiving portion and a transmitting portion through a transmission/reception branch circuit element (a duplexer DPX, a circulator (not shown), a surface acoustic wave element (not shown), or the like).

Action of the second isolator 2 in the seventh preferred embodiment is the same as that of the first isolator 1 in the above sixth preferred embodiment.

Eighth Preferred Embodiment

Figure 18:
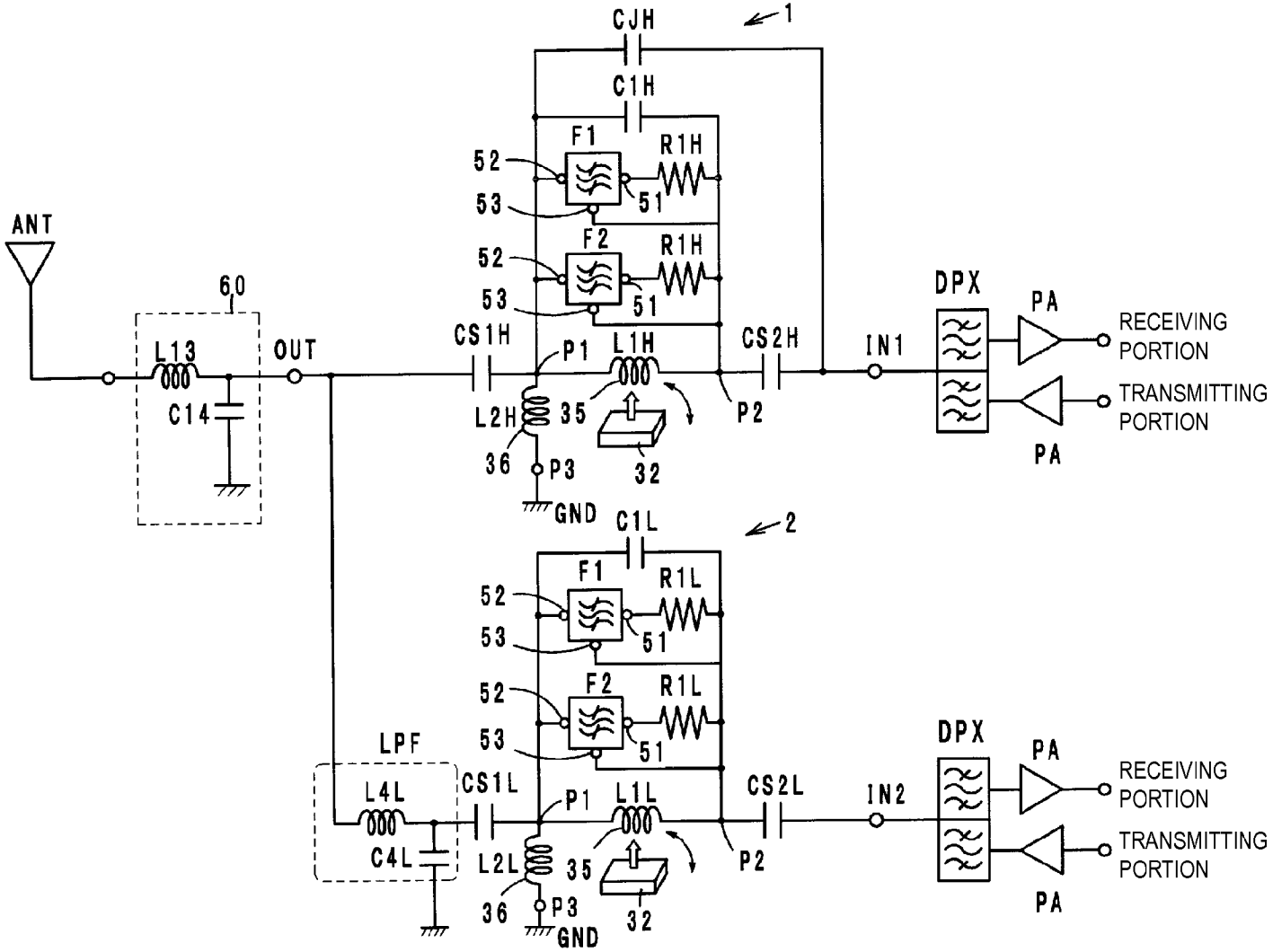
FIG. 18 is an equivalent circuit diagram illustrating an irreversible circuit element according to an eighth preferred embodiment of the present invention.

As shown in FIG. 18, an irreversible circuit element according to an eighth preferred embodiment of the present invention includes a filter F2 and the resistor R1H, in addition to the filter F1 and the resistor R1H, that are connected in each of the first and second isolators 1 and 2 in parallel. Characteristics required for the irreversible circuit element can be obtained by selecting filters having the desired characteristics as the filters F1 and F2, respectively. In particular, the configuration of this preferred embodiment is useful in the case where there are a plurality of predetermined frequency bands used in the transmission, and these frequency bands are so close to each other on the frequency axis that they cannot be included in all the pass bands by a single filter. Further, the configuration of the present preferred embodiment is also useful in the case where there are a plurality of predetermined frequency bands used in the transmission, and these frequency bands are spaced from each other on the frequency axis and only these plurality of transmission frequency bands are selectively passed from the input terminal to the output terminal.

Ninth Preferred Embodiment

Figure 19:
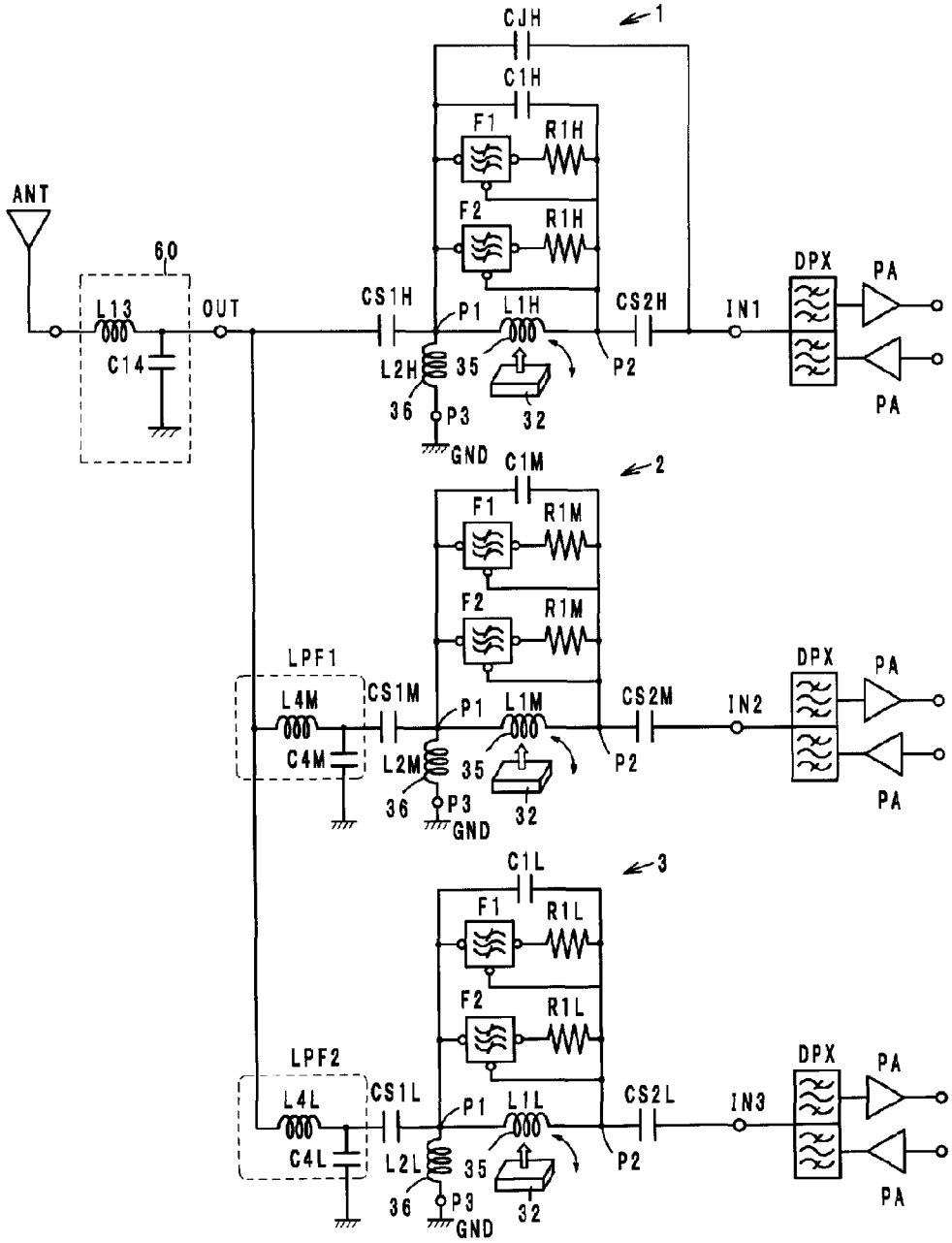
FIG. 19 is an equivalent circuit diagram illustrating an irreversible circuit element according to a ninth preferred embodiment of the present invention.

As shown in FIG. 19, an irreversible circuit element according to a ninth preferred embodiment of the present invention includes the first isolator 1, the second isolator 2, and a third isolator 3 each of which is equipped with the filters F1 and F2. A pass frequency band of the first isolator 1 is higher than a frequency band of the second isolator 2, and the frequency band of the second isolator 2 is higher than a frequency band of the third isolator 3. Further, respective output portions of the isolators 1, 2, and 3 are electrically connected and defined as the one output terminal OUT. Note that in FIG. 19, the letter "H" is added to the end of a reference numeral for each circuit component in the first isolator 1, the letter "M" is added in the second isolator 2, and the letter "L" is added in the third isolator 3.

Figure 20:
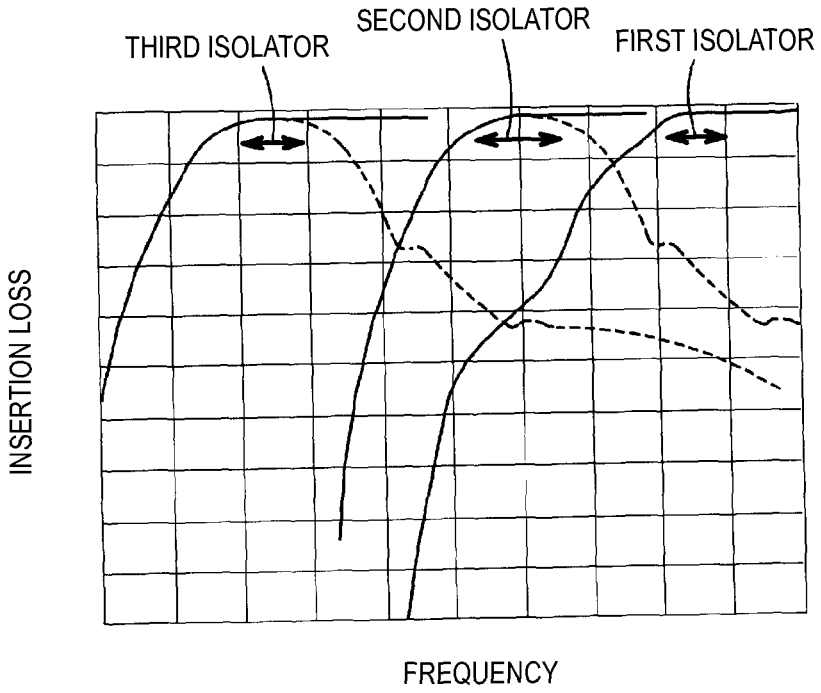
FIG. 20 is a graph illustrating insertion loss characteristics of respective isolators in the irreversible circuit element according to the ninth preferred embodiment of the present invention.

Further, the low pass filter LPF1 (it may be a bandpass filter instead) is inserted between the output terminal OUT and the output portion of the second isolator 2, and the low pass filter LPF2 is connected between the output terminal OUT and the output portion of the third isolator 3. Respective insertion loss characteristics of the isolators 1, 2, and 3 according to the ninth preferred embodiment are shown in FIG. 20; the configuration of this preferred embodiment is such that transmitting and receiving operations can be carried out while switching three frequency bands.

Other Preferred Embodiments

The irreversible circuit element and the module according to the present invention are not limited to the above preferred embodiments, and can be variously changed without departing from the scope and the spirit of the invention.

For example, the configuration of the ferrite magnet element 30, the shapes of the first and second center electrodes 35 and 36, and the like can be variously changed. Further, the capacitance elements, the resistance elements, and the like may not be chip components externally mounted on a circuit substrate, and may be such components that are embedded in a circuit substrate as a multilayer body.

The module according to various preferred embodiments of the present invention includes at least two isolators, and may further include, if needed, the matching circuit (60) that is connected to the output side, and the bandpass filter (BPF), the duplexer (DPX), the power amplifier (PA), and the like that are connected to the input side.

As discussed thus far, various preferred embodiments of the present invention are useful for irreversible circuit elements and modules, and are particularly excellent in a point that communication operation is able to be carried out in a plurality of frequency bands, reduction in the number of components and costs in a transmission circuit is achieved, and load fluctuation on the antenna side is significantly reduced or prevented.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An irreversible circuit element comprising:

a first high pass isolator and a second high pass isolator each including first and second center electrodes intersecting with and insulated from each other on a ferrite to which a direct-current magnetic field is applied with a permanent magnet, one end of the first center electrode is an output port and the other end of the first center electrode is an input port, and one end of the second center electrode is the output port and the other end of the second center electrode is a ground port in each of the first and second isolators, a resistance element and a capacitance element connected in parallel to each other are connected between the input port and the output port in series in each of the first and second isolators; wherein a pass frequency band of the first isolator is higher than a pass frequency band of the second isolator;

respective output portions of the first and second isolators are electrically connected and define one output terminal; and a low pass filter is disposed between the output terminal and the output port of the second isolator.

2. The irreversible circuit element according to claim 1, wherein the low pass filter is an L-type filter or an π-type filter including an inductor and a capacitor.

3. The irreversible circuit element according to claim 1, wherein the low pass filter includes at least two low pass filters connected in two stages.

4. The irreversible circuit element according to claim 1, wherein the low pass filter includes a strip line.

5. A module comprising:

the irreversible circuit element according to claim 1; wherein the output terminal of the irreversible circuit element is connected to an antenna side.

6. The irreversible circuit element according to claim 1, wherein in the first isolator and/or the second isolator, input/output terminals of at least one filter are connected between the resistance element and the output port or the input port, and a ground terminal of the at least one filter is connected to the input port or the output port.

7. A module comprising:

the irreversible circuit element according to claim 6; wherein the at least one filter passes a transmission band signal and attenuates a receiving band signal; and the module further includes a branch circuit element that causes a transmission signal and a receiving signal to branch to the input port of the first isolator and/or the second isolator provided with the at least one filter.

8. An irreversible circuit element comprising:

a first high pass isolator and a second high pass isolator each including first and second center electrodes intersecting with and insulated from each other on a ferrite to which a direct-current magnetic field is applied with a permanent magnet, one end of the first center electrode is an output port and the other end of the first center electrode is an input port, and one end of the second center electrode is the output port and the other end of the second center electrode is a ground port in each of the first and second isolators, a resistance element and a capacitance element connected in parallel to each other are connected between the input port and the output port in series in each of the first and second isolators; wherein a pass frequency band of the first isolator is higher than a pass frequency band of the second isolator;

the input port of the first isolator defines a first input terminal;

the input port of the second isolator defines a second input terminal;

the output port of the first isolator and the output port of the second isolator are electrically connected and define one output terminal; and a low pass filter is disposed between the output terminal and the output port of the second isolator.

9. A module comprising:

the irreversible circuit element according to claim 8; wherein the output terminal of the irreversible circuit element is connected to an antenna side of the module;

the first input terminal of the irreversible circuit element is connected to a first power amplifier side of the module; and the second input terminal of the irreversible circuit element is connected to a second power amplifier side of the module.

* * * * *